US005556485A

United States Patent [19]

Taylor et al.

[11] Patent Number: 5,556,485

[45] Date of Patent: Sep. 17, 1996

[54] BAKE HARDENABLE VANADIUM CONTAINING STEEL AND METHOD OF MAKING THEREOF

[75] Inventors: Keith A. Taylor, Coplay; John G. Speer, Bethlehem, both of Pa.

[73] Assignee: Bethlehem Steel Corporation, Bethlehem, Pa.

[21] Appl. No.: 335,004

[22] Filed: Nov. 7, 1994

[51] Int. Cl.[6] ..... C21D 8/04; C22C 38/12

[52] U.S. Cl. ..... 148/320; 148/651; 148/530; 148/537; 148/547

[58] Field of Search ..... 148/320, 651, 148/661, 518, 537, 530, 547; 420/127

[56] References Cited

U.S. PATENT DOCUMENTS

| | | | |
|---|---|---|---|
| 1,420,328 | 6/1922 | McConnell . | |
| 1,546,176 | 7/1925 | Mathesius et al. . | |
| 2,291,842 | 8/1942 | Strauss | 75/58 |
| 2,999,749 | 9/1961 | Saunders et al. | 75/58 |
| 3,375,105 | 3/1968 | Lynch | 75/129 |
| 3,600,160 | 8/1968 | Simcoe et al. | 75/123 J |
| 3,897,280 | 7/1975 | Gondo et al. | 148/12 C |
| 3,947,293 | 3/1976 | Takechi et al. | 148/12 F |
| 4,050,959 | 9/1977 | Nakaoka et al. | 148/12.3 |
| 4,144,378 | 3/1979 | Kim | 428/653 |
| 4,313,770 | 2/1982 | Takahashi et al. | 148/12 C |
| 4,375,376 | 3/1983 | Rowden et al. | 148/12 F |
| 4,391,653 | 7/1983 | Takechi et al. | 148/12 C |
| 4,398,970 | 8/1983 | Marder et al. | 148/12 F |
| 4,496,400 | 1/1985 | Irie et al. | 148/12 C |
| 4,750,952 | 6/1988 | Sato et al. | 148/320 |
| 4,909,861 | 3/1990 | Muraoka et al. | 148/12.7 A |
| 5,123,969 | 6/1992 | Chou | 148/547 |
| 5,133,815 | 7/1992 | Hashimoto et al. | 148/319 |
| 5,139,580 | 8/1992 | Freier et al. | 148/547 |
| 5,279,683 | 7/1994 | Okada et al. | 148/546 |

FOREIGN PATENT DOCUMENTS

| | | | |
|---|---|---|---|
| 0572666 | 8/1993 | European Pat. Off. | C22C 38/14 |
| 57-140868 | 8/1982 | Japan | 148/320 |
| 246327 | 11/1986 | Japan . | |
| 194126 | 7/1990 | Japan . | |
| 4218618A | 8/1992 | Japan . | |
| 246153 | 9/1992 | Japan . | |

OTHER PUBLICATIONS

Scripta Metallurgica et Materialia, vol. 32, No. 1, pp. 7–12, 1995, "Solubility Products For Titanium–, Vanadium–, and Niobium–Carbide in Ferrite", Keith A. Taylor.

Comm. Eur. Communities Report, EUR Rep. #9968, 1986. Abstract of a report directed to contiuous annealing of precipitation strengthened low carbon steels.

Stahl u. Esin 113 (1993) nr. 10 "Bake–Hardening—A Possibility of Increasing the Yield Strength of Sheet Steel", Patrick Eisen and Hans Paul Houghardy.

Iron and Steelmaking, vol. 21, No. 3, 1994, "Ferrous Metallurgy at the University of Leeds", Terry Gladmann. See p. 171, Interstitial free steels.

Kawasaki Steel Tech. Rpt. #27 Nov. 1992, "Development of Bake–Hardening High Strength Cold Rolled Sheet Steels for Automotive Exposed Panels" S. Satoh, et al.

SAE Tec. Paper Series Feb. 25, 1991 "Development of a New Bake–Hardenable Galvannealed Sheet Steel For Automotive Exposed Panels" T. Tanioku, et al.

Tetsu–to–Hagane, vol. 79, 1993, pp. 76–82. "Bake Hardenability of Cold Rolled Ti–Bearing Extra Low Carbon Sheet Steels due to Precipitation Control", K. Kawasaki, et al.

*Primary Examiner*—Deborah Yee

[57] ABSTRACT

Rolled articles such as hot rolled or cold rolled and annealed sheet and/or strip include effective amounts of vanadium in low carbon steels to produce an improved bake hardenable product especially adapted for automotive use. The use of vanadium in the alloy steel chemistry controls bake hardenability, permits solution annealing at lower temperatures in its manufacturing sequence and specifies a composition range which is more easily cast within desired limits and causes less variation in final mechanical properties.

22 Claims, 1 Drawing Sheet

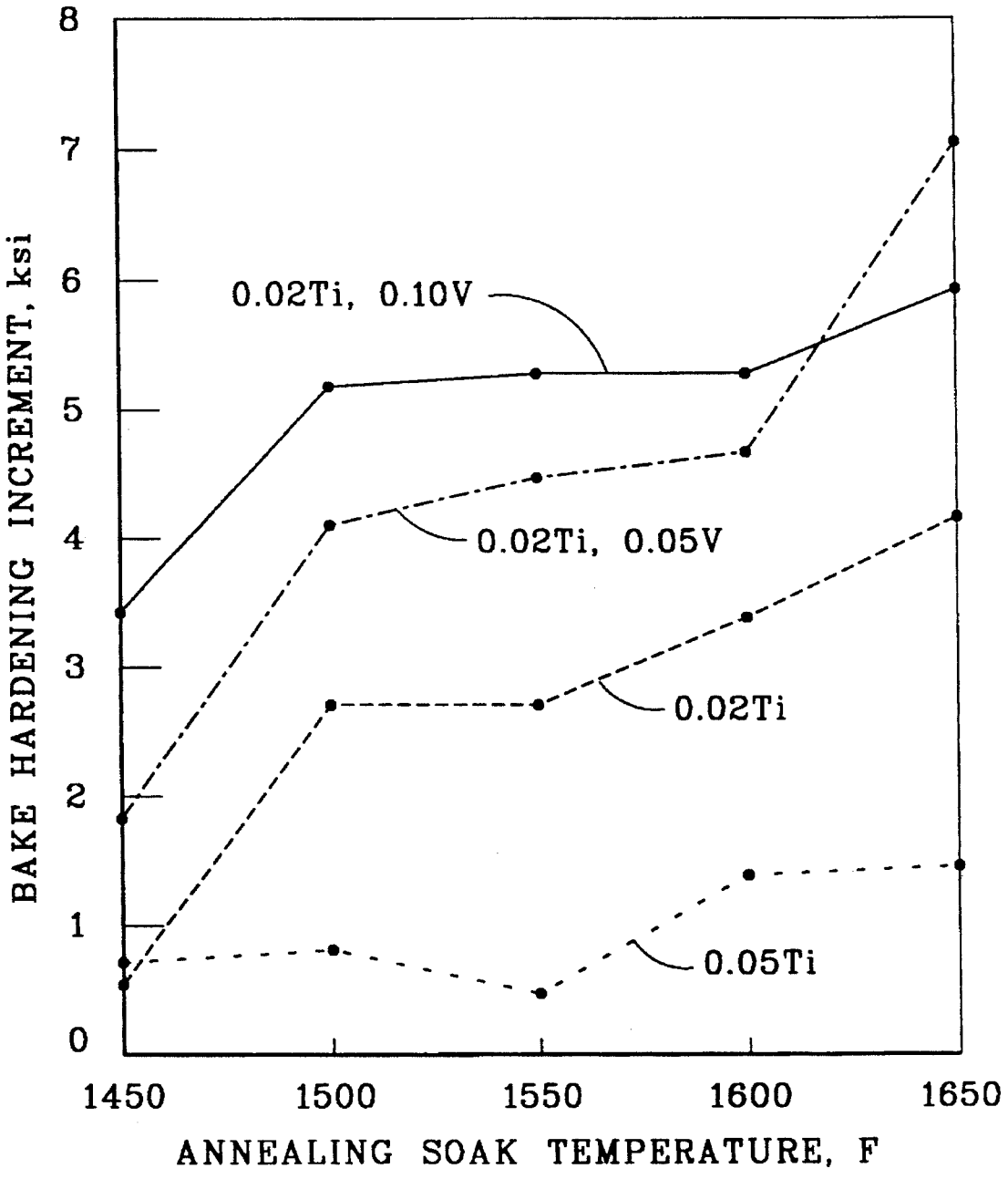
8
7
6
5
4
3
2
1
0
BAKE HARDENING INCREMENT, ksi
0.02Ti, 0.10V
0.02Ti, 0.05V
0.02Ti
0.05Ti
1450
1500
1550
1600
1650
ANNEALING SOAK TEMPERATURE, F

BAKE HARDENABLE VANADIUM CONTAINING STEEL AND METHOD OF MAKING THEREOF

FIELD OF THE INVENTION

The present invention is directed to a low carbon steel strip product and method for making which has improved bake hardenability properties and, in particular, a steel strip product having controlled mounts of vanadium.

BACKGROUND ART

In the prior art, there has been an ever increasing demand, particularly by automobile manufacturers, for higher strength steel sheet and strip to provide both dent resistance and weight reduction in new automobile vehicle designs. With this desire, an increasing demand is seen for steels which are highly formable but also exhibit bake hardenability. As is well known in the art, bake hardenability refers to the strengthening that occurs in certain steels during the automotive paint baking treatment, typically around 350° F for 20 or 30 minutes. During the paint baking or other suitable treatment, a bake hardenable steel is strengthened to provide the desired dent resistance in the final product.

The attributes of formability (such as press formability or press shapability) and strength are at conflict in a given steel. To achieve good formability, the steel must be ductile in nature to be formed into the desired shape. Along with this ductility, however, the steel must also retain sufficient strength to resist denting when used in exposed panels such as those found in automobiles.

The prior an has proposed various solutions to overcome this conflict through the control of the steel alloying components as well as the process used for manufacturing the steel product. Bake hardenability is an attractive attribute contributing to these solutions because such hardening occurs after forming.

U.S. Pat. No. 5,133,815 to Hashimoto et al. discloses a cold-rolled or hot-dipped galvanized steel sheet for deep drawing. Bake hardenability is improved by control of the alloying steel components and a carburization step to obtain the proper concentration of solute carbon in the steel sheet.

U.S. Pat. No. 4,391,653 to Takechi et al. discloses a high strength cold-rolled strip having improved bake hardenability as a result of controlling the nitrogen content of the cold-rolled strip.

U.S. Pat. No. 4,496,400 to Irie et at. relates to cold-rolled steel sheets suitable for external automotive sheet. This patent discloses an effective compounding mount of niobium, which acts to fix C and N in the steel in the presence of a proper amount of aluminum and an annealing condition capable of developing effectively the contribution of niobium. Continuous annealing of this steel requires a detailed heating and cooling regimen to obtain the bake hardening effect.

U.S. Pat. No. 4,750,952 to Sato et at. also discloses a cold-rolled steel sheet having improved bake hardenability. In this patent, the amount of sulfur and nitrogen is limited and the addition of titanium is restricted to a specific range in consideration of the sulfur and nitrogen amounts. This patent also requires "time/energy intensive" annealing (i.e. greater than 300 seconds above re, crystallization temperatures).

For automotive skin panel applications, coated steels such as hot dipped steels are preferred for their corrosion resistance. However, alloys especially suited for hot-dipped coating often have compositions which render them generally interstitial-free (IF). In these types of alloys, the alloying components effectively remove all of the carbon from solution which precludes bake hardenability.

Thus, a need has developed to provide improved methods and alloy chemistries which permit the manufacture of hot-dipped coated products which have both acceptable formability and bake hardenability properties.

Further, in view of the need for precise chemistry controls with steel compositions utilizing alloying components such as titanium and/or niobium, a need has developed to provide an alloy chemistry suitable for bake hardening which does not require precise and extremely low alloy component limits and energy intensive processing requirements.

Responsive to this need, the present invention provides an improved hot rolled or cold-rolled and annealed low carbon steel product suitable for sheet applications such as automotive sheet which has an alloy chemistry which is more easily controlled than prior art chemistries and also has less energy intensive and less demanding processing requirements.

SUMMARY OF THE INVENTION

It is a first object of the present invention to provide a low carbon steel strip and sheet which has excellent bake hardenability, (in combination with suitable aging resistance prior to forming) and is especially adapted for use in automobile manufacture.

Another object of the present invention is to provide a method of making a hot rolled or cold rolled and annealed strip and/or sheet product having improved flatness and which is less energy intensive by an alloy chemistry which permits lower annealing temperatures to achieve final product qualifies.

Other objects and advantages of the present invention will become apparent as a description thereof proceeds.

In satisfaction of the foregoing objects and advantages, the present invention, in its broadest embodiment is concerned with hot rolled or cold-rolled and annealed articles and methods of making these articles. More preferably, the steel is continuously annealed and coated by techniques such as hot-dip coating or electrogalvanizing for use in automobile sheet or plate.

The present invention is an improvement over the prior art method of making hot rolled or cold-rolled and annealed articles by the steps of casting carbon steel containing effective amounts of carbon, manganese, aluminum, nitrogen with the balance iron and incidental impurities wherein the east steel is subsequently hot-rolled and cooled, and may then be cold-rolled to gauge and annealed in a selected temperature range. According to the invention, the steel has a composition consisting essentially in weight percent of between 0.0005 and less than 0.1% carbon, between zero and less than 0.04% nitrogen, between zero and less than 0.5% titanium, between zero and 0.5% aluminum, between zero and up to 2.5% manganese, between 0.005 and 0.6% vanadium with the balance iron and incidental impurities.

The vanadium addition contributes to improved bake hardenability properties of the cold-rolled and annealed articles. Moreover, the wide permissible weight percentage range of vanadium makes it easier to cast a steel within tolerances and provides a product which has final mechanical properties which are relatively insensitive to variations in the vanadium content.

The inventive ahoy chemistry contributes to improved bake hardenability when the steel article is subjected to paint baking. Bake hardenability can be controlled by the use of vanadium Within the prescribed ranges.

In another aspect of the invention, a rolled steel article, e.g. a hot rolled or cold-rolled and annealed article, is provided consisting essentially in weight percent between 0.0005 and 0.1% carbon, between zero and less than 0.04% nitrogen, between zero and less than 0.5% titanium, between zero and 0.5% aluminum, between zero and up to 2.5% manganese, between 0.005 and 0.6% vanadium with the balance iron and incidental impurities. Preferably, the steel consists essentially in weight percent of between 0.0005 and 0.01% carbon, between zero and less than 0.008% nitrogen, between zero and less than 0.05% titanium, between zero and 0.10% aluminum, between zero and up to 1.0% manganese, between 0.01 and 0.15% vanadium with the balance iron and incidental impurities. The inventive cold-rolled and annealed article can be coated in any conventional fashion such as hot-dipping or electrogalvanizing. The inventive steel article exhibits improved bake hardenability as a result of the vanadium addition and provides a steel article with improved shape and an alloy chemistry more easily controlled during melting and casting.

The inventive alloy chemistry also permits lower solution annealing temperatures than prior art alloys and lower energy costs associated with its manufacture.

BRIEF DESCRIPTION OF THE DRAWINGS

Reference is now made to the sole drawing of the invention wherein a graph depicts the relationship between bake hardenability in KSI and solution annealing temperatures for the invention.

DESCRIPTION OF THE PREFERRED EMBODIMENTS

It has been discovered that a low carbon steel can be modified with effective amounts of vanadium to produce a bake hardenable hot rolled or cold-rolled and annealed article especially suitable for automotive sheet in a coated condition.

The inventive alloy chemistry achieves desirable bake hardenability properties at lower solution annealing temperatures and is more "producer friendly" during article manufacture. That is, using vanadium in the prescribed amounts in the ahoy steel chemistry makes it easier to cast the steel within tolerances so as to produce an acceptable product. The weight percentage of vanadium extends to levels higher than other prior art alloying components and is more easily controlled during casting. Moreover, the inventive alloy chemistry is less prone to wide variations in the final mechanical properties, since typical variations in vanadium content do not greatly alter the mechanical properties.

In its broadest embodiment, the invention comprises a bake hardenable hot rolled or cold-rolled and annealed steel article such as a sheet or strip of the low carbon type. The rolled steel article consists essentially in weight percent of between 0.0005 and 0.1% carbon, between zero and less than 0.04% nitrogen, between zero and less than 0.5% titanium, between zero and 0.5% aluminum, between zero and up to 2.5% manganese, between 0.005 and 0.6% vanadium with the balance iron and inevitable impurities. Preferably, carbon is up to 0.01%, nitrogen is up to 0.008%, titanium is up to 0.05% and vanadium is up to 0.15%.

The addition of manganese in these types of steel is conventional as manganese acts as both a strengthening element and combines with sulfur to prevent red-shortness of the steel.

Since the hot rolled or cold-rolled and annealed steels of the invention are killed steels, aluminum is contained therein for its deoxidation effect. Preferably, the aluminum is limited to 0.08%.

Nitrogen, as stated above, has an upper limit of 0.04% (400ppm). Preferably, the nitrogen is limited to less than 0.008%.

The low carbon steel of the invention requires a finite amount of carbon in order to achieve the bake hardenability effect. Generally, this lower limit is around 0.0005% carbon (5ppm). The upper limit is preferably 0.005%.

Although silicon and phosphorous in these types of low carbon steels are often at residual impurity levels, other specific end uses of the steel product may require higher additions to achieve higher levels of strength. Thus, depending on the final use, silicon and phosphorous could be added separately or in combination in mounts up to 1.0% and 0.25% by weight, respectively. Other elements may also contribute to solution strengthening, but Mn, P, and Si are typically used in low carbon sheet steels for this purpose.

Titanium is added to the steel mainly to remove solute nitrogen through formation of nitrogen compounds such as titanium nitride. This allows control of bake hardenability simply by controlling the level of solute carbon. Preferably, the titanium level should be at least 3.4 times the weight percent concentration of nitrogen. It should be understood that other strong nitride-forming elements, such as boron, zirconium, or even aluminum or vanadium in suitable levels with proper processing, may be substituted for titanium to combine with solute nitrogen.

Sulfur is not normally added to low carbon sheet steels, but is present in residual amounts which depend on the steelmaking and ladle treatment methods employed. Sulfur in the final product may be typically found in the form of various compounds, including titanium sulfide (TiS). With the above consideration relating to titanium nitride formation, and recognizing that some titanium may react with sulfur to form TiS, the preferred level of titanium is between 3.4N and (3.4N+1.5S), where N and S are the weight percent concentrations of nitrogen and sulfur, respectively.

Vanadium is also added to control bake hardenability of the hot rolled or cold-rolled and annealed steel articles. The vanadium preferably ranges between 0.03 and 0.12% and more preferably 0.05 and 0.10%.

As will be shown below, vanadium additions can control bake hardenability, such control not heretofore recognized in the prior art. For certain alloy chemistries according to the invention, increases in bake hardenability have been shown with the addition of vanadium.

The inventive cold-rolled and annealed steel can be subsequently processed into a coated steel and press formed into various shapes for any end use. In particular, these coated products are especially adapted for use as automotive sheet or plate wherein the coated product is subsequently painted and baked to achieve the bake hardenability effect and dent resistance in a vehicle's exposed panels. The coating may be any conventional coating typically used in these types of application such as zinc, aluminum or the like.

In another aspect of the invention, the inventive steel chemistry provides improvements in prior art techniques of cold-rolling and annealing these types of materials. In these prior art processes, a particular steel is cast into either ingot form or continuously cast into slab and hot-rolled and cooled into coil form. The hot rolled product can be used or, alternatively, the coil form is subsequently cleaned, e.g., pickled, and cold-rolled in a number of passes to a desired gauge. The cold-rolled steel is then annealed, either in batch form or in a continuous fashion to produce a recrystallized steel article.

These prior art processes also can include coating the cold-rolled and annealed product by techniques such as electrogalvanizing or hot-dip coating. These coating steps can be done either after the batch annealing or as part of a continuous annealing line. The invention provides improvements over these prior art processes in that the inventive alloy steel chemistry described above permits lower solution annealing temperatures to be utilized, particularly during continuous annealing, than prior art alloying chemistries. For example, in U.S. Pat. No. 4,496,400 to Irie et at., a niobium-containing bake hardenable thin steel sheet is annealed at a minimum of 900° C. (1,652° F.).

In contrast, attractive bake hardenability can be achieved with the inventive alloy chemistry at annealing temperatures above about 1450° F. (788° C.). This lower annealing temperature also results in energy savings during annealing and a lower product unit cost, as well as better control of product shape and flatness.

The use of vanadium in the inventive alloy chemistry permits lowering of the solution annealing temperature since vanadium is more soluble in the steel matrix than alloying components such as titanium or niobium. Consequently, lower solution annealing temperatures can be used for achieving the necessary level of carbon in solute form for bake hardenability. The effective annealing temperature range can be as low as around 1,450° F. and up to about 1,650° F. Preferably, the solution annealing treatment is within the range of 1,500 to 1,550° F. to achieve both adequate recrystallization, bake hardenability, improved product shape/flatness and lower energy costs.

It should be understood that the processing steps of casting, hot rolling and cooling and cold-rolling are well known in the metallurgical arts for these types of low carbon steels and a further detailed description thereof is not deemed necessary for understanding of the invention.

In order to demonstrate the unexpected results associated with the use of vanadium in these types of low carbon steels, the following experiments were conducted. It should be noted that all percentages are in weight percent unless otherwise indicated. Experiments are intended for illustration purposes and are not considered to be limiting as to the invention.

Three 500 pound experimental heats were cast into ingot form under laboratory conditions and subsequently hot rolled to a thickness of 0.75 inches. The compositions of the heats were nominally 0.003% carbon - 0.2% manganese - 0.004 to 0.007% nitrogen - 0.02 to 0.04% aluminum - 0.02% titanium and selected amounts of vanadium with the balance iron and impurities.

The hot rolled ingots were heated to 2,300° F. and further rolled from ¾ inches to 0.12 inches. In order to simulate water-spray run-out table cooling after hot-rolling, the rolled ingots were quenched in a polymer solution until a conventional coil cooling temperature was reached. At this point, the hot-rolled samples were furnace-cooled to ambient temperature.

Each hot-rolled sample was then pickled and cold-rolled from 0.12" to 0.03" in a plurality of passes to achieve about a 75% cold reduction.

The cold-rolled material was then subjected to annealing at temperatures between 1,450 and 1,650° F. for times of thirty seconds followed by air cooling and temper rolling-(cold reduction of about 1%). The temper-rolled steel was subjected to a standard bake hardening simulation, consisting of 2% tensile prestrain followed by treatment at 350° F. for 30 minutes. The bake hardenability increment represents the difference between the yield stress after aging and the 2% flow stress prior to aging. The material was also subjected to strain aging index testing, involving prestraining of 10% followed by treatment at 212° F. for 60 minutes, to provide an indication of the room-temperature aging resistance of the processed steel.

The following table summarizes the actual compositions in weight percents for the experiment.

TABLE

| Steel* | C | Mn | Al | N | Ti | V |
|---|---|---|---|---|---|---|
| 0.02 Ti | 0.0018 | 0.20 | 0.024 | 0.0044 | 0.018 | — |
| 0.02 Ti-0.05 V | 0.0021 | 0.19 | 0.038 | 0.0062 | 0.021 | 0.049 |
| 0.05 V | | | | | | |
| 0.02 Ti-0.10 V | 0.0028 | 0.19 | 0.040 | 0.0065 | 0.021 | 0.094 |

*Balance iron and residual impurities

With reference now to the sole figure, a comparison is shown between bake hardening increments and annealing soak temperature for four different alloy chemistries. The three curves showing 0.02 titanium correspond to the three chemistries identified in the table. The curve showing 0.05 titanium is representative of an excess stabilized low carbon steel sheet which is adaptable for hot-dipping but does not exhibit significant bake hardenability.

As is clearly evident from the sole figure, vanadium, in an effective amount, controls bake hardenability in a low carbon steel. This figure shows that adding a small amount of vanadium to a titanium containing low carbon steel, i.e. 0.05% vanadium, results in equivalent bake hardenability at an annealing temperature of 1,500° as opposed to a 1,650° temperature for a similar composition without vanadium. Even more improved bake hardening is achieved when the vanadium is increased up to 0.10%. This increase is also effective at low annealing temperatures, e.g. 1450° F. or 1,500° F. This figure shows that bake hardenability is increased up to approximately 3 KSI over a non-vanadium containing steel at these low annealing temperatures. Furthermore, the results of testing for strain-aging index indicated that these steels exhibit sufficient resistance to aging at ambient temperature prior to forming.

The improved bake hardenability of the inventive alloy steel chemistry, the lower solution annealing temperatures, the improved sheet or strip shape and flatness, the ability to easily control the vanadium addition during casting and the reduced sensitivity between vanadium content variations and final mechanical properties makes this steel ideal for use in sheet and/or strip products either in the hot rolled or cold-rolled and annealed state or as a coated product. Given the improvements over interstitial free steels and "producer friendly" characteristics of the inventive rolled article and method of making, the steel is especially suited for hot-dipped coating processes such as galvannealing or the like.

The cold-rolled and annealed steel article employing the inventive alloy steel chemistry can be hot-dipped coated in any conventional fashion, preferably in a continuous annealing hot-dipped coating line. Once hot-dipped coated, the coated steel article can be formed in conventional fashion into automotive panels. The panels are easily formed and are subsequently painted and baked, the painted panels showing good dent resistance.

As such, an invention has been disclosed in terms of preferred embodiments thereof which fulfill each and every one of the objects of the present invention as set forth hereinabove and provides an improved low carbon steel article and method of manufacturing which utilizes vanadium as an alloying component for improved bake hardenability and lower energy consumption during manufacture.

Of course, various changes, modifications and alterations from the teaching of the present invention may be contemplated by those skilled in art without departing from the intended spirit and scope thereof. Accordingly, it is intended that the present invention only be limited by the terms of the appended claims.

We claim:

1. In a method of making a rolled steel article comprising the steps of casting a low carbon steel containing carbon, manganese, aluminum, nitrogen with the balance iron and incidental impurities and hot rolling said steel, the improvement comprising:

providing said steel with a composition consisting essentially in weight percent of between 0.0005 and 0.0028% carbon, between zero and less than 0.04% nitrogen, between zero and less than 0.5% of a nitride forming element, between zero and 0.5% aluminum, between zero and up to 2.5% manganese, between 0.005 0.03 and 0.094% vanadium with the balance iron and inevitable impurities, wherein said vanadium contributes to improved bake hardenability of said steel when subjected to paint baking.

2. The method of claim 1 wherein said hot rolled steel is cold rolled and annealed in a selected temperature range.

3. The method of claim 2 wherein said improvement further comprises said temperature range having a lower limit of about 1,450° F.

4. The method of claim 1 wherein said vanadium ranges between 0.05 and 0.094%.

5. The method of claim 1 wherein bake hardenability is increased by at least 3 KSI from said vanadium addition.

6. The method of claim 1 wherein said steel consists essentially of by weight 0.0018 to 0.0028% carbon, 0.18–0.22% manganese, 0.024–0.040% aluminum, 0.0044 to 0.0065% nitrogen, 0.018–0,022% titanium as said nitride forming element, and 0,049–0.094% vanadium with the balance iron and inevitable impurities.

7. The method of claim 1 wherein said steel is coated.

8. The method of claim 7 wherein said steel is coated by hot-dipping.

9. The method of claim 7 wherein said steel sheet is coated by electrogalvanizing.

10. The method of claim 1 wherein said steel is formed into a sheet product and subjected to a paint baking step.

11. A rolled steel article consisting essentially of by weight percent:

0.0005 to less than 0.0028% carbon;

between zero and up to 2.5% manganese;

between zero and up to 0.5% aluminum;

between zero and less than 0.5% of a nitride-forming element;

between zero and less than 0.04% nitrogen;

between 0.03 and less than 0.094% vanadium;

the balance iron and incidental impurities, wherein vanadium contributes to improved bake hardenability when said article is subjected to paint baking.

12. The rolled article of claim 11 wherein said vanadium ranges between 0.05 and 0.094%.

13. The rolled article of claim 11 wherein said nitride-forming element is titanium in a range between 0.015 and 0.025%. The rolled article of claim 11 wherein carbon is less than 0.005%.

14. The rolled article of claim 11 wherein said article includes a coating thereon.

15. The rolled article of claim 11 wherein said article exhibits bake hardenability of at least 4 KSI.

16. The rolled article of claim 11 wherein said steel consists essentially of by weight 0.0018 to 0.0028% carbon, 0.18–0.22% manganese, 0.024–0.040% aluminum, 0.0044 to 0.0065% nitrogen, 0.018–0.022% titanium as said nitride-forming element, and 0.049–0.094% vanadium with the balance iron and inevitable impurities.

17. The rolled article of claim 11 wherein said nitride-forming element is titanium in an amount of about 0.02%.

18. The method of claim 1 wherein said carbon ranges between 0.001 and 0028%, said nitrogen ranges between 0.001 and 0.005%, said aluminum ranges between 0.02 and 0.08% and titanium as said nitride-forming element is in an amount greater than 3.4×said nitrogen amount.

19. The rolled article of claim 11 wherein said carbon ranges between 0.001 and 0.0028%, said nitrogen ranges between 0.001 and 0.005%, said aluminum ranges between 0.02 and 0.08% and titanium as said nitride-forming element is in an amount greater than 3.4×said nitrogen amount.

20. The rolled steel article of claim 11 in which phosphorus is added in an amount having a range about zero to 0.025%.

21. The rolled steel article of claim 11 in which silicon is added in an amount having a range of between about zero to 1.0%.

22. The rolled steel article of claim 11 in which both phosphorus and silicon are added together in an amount having a range of between about zero to 1.25%.

* * * * *

UNITED STATES PATENT AND TRADEMARK OFFICE

CERTIFICATE OF CORRECTION

PATENT NO. : 5,556,485

DATED : September 17, 1996

INVENTOR(S) : Keith A. Taylor, John G. Speer

It is certified that error appears in the above-indentified patent and that said Letters Patent is hereby corrected as shown below:

Col. 7, line 29, delete "0.005" before -- 0.03 and 0.094% vanadium --.

Signed and Sealed this

Twenty-sixth Day of November 1996

*Attest:*

Bruce Lehman

BRUCE LEHMAN

*Attesting Officer*

*Commissioner of Patents and Trademarks*